United States Patent [19]

Jones

[11] 4,257,592

[45] Mar. 24, 1981

[54] EXERCISING APPARATUS WITH IMPROVEMENTS IN HANDLE STRUCTURE, ROPE ARRANGEMENT, AND CLAMPING MEANS

[76] Inventor: Arthur Jones, P.O. Box 1783, DeLand, Fla. 32720

[21] Appl. No.: 964,558

[22] Filed: Nov. 29, 1978

[51] Int. Cl.[3] ..... A63B 21/00

[52] U.S. Cl. ..... 272/126; 272/DIG. 4; 272/143; 24/115 K

[58] Field of Search ..... 272/126, 134, 143, DIG. 4, 272/138, 116, DIG. 2, 75, 74; 220/94 R; 16/110 R; 24/115 H, 115 K, 120, 132 R, 134 L, 133

[56] References Cited

U.S. PATENT DOCUMENTS

| | | | |
|---|---|---|---|
| 481,730 | 8/1892 | Miller | 272/136 |
| 1,240,191 | 9/1917 | Fox | 272/126 |
| 1,372,026 | 3/1921 | Hutter | 272/138 |
| 1,746,111 | 2/1930 | Fisher . | |
| 1,749,488 | 3/1930 | King | 272/126 |
| 2,933,157 | 4/1960 | Huber | 24/133 X |
| 3,369,809 | 2/1960 | Morrill | 272/126 X |
| 3,843,119 | 10/1974 | Davis | 272/126 |

FOREIGN PATENT DOCUMENTS

| | | | |
|---|---|---|---|
| 21443 | 5/1905 | Austria | 272/75 |
| 6802124 | 2/1968 | Netherlands | 272/136 |

OTHER PUBLICATIONS

"Body Conditioning"–Nautilus Sports/Medical Industries, P.O. Box 5000, DeLand, Fla. 32720

*Primary Examiner*—William R. Browne
*Attorney, Agent, or Firm*—Karl W. Flocks

[57] ABSTRACT

Exercising apparatus comprising in combination an elongate housing with a first surface having a first slot adjacent one end thereof and a second slot adjacent the opposite end thereof; first and second pulleys rotatably supported between opposite sides of the housing and extending out of the first and second slots, respectively; a rope having first and second ends and first and second intermediate portions; first and second handles secured to the first and second ends of the rope, respectively; a clamping device operably associated with the rope for selectively extending or reducing the effective length of the rope; and a loop forming member for securing the first end of the rope around the first handle, the loop forming member having structure readily enabling selective expansion and contraction of the loop to position and secure the first end of the rope at any one of several desired locations on the first handle. The first intermediate portion of the rope extending along a first segment into a first opening of the clamping device, out a second opening of the clamping device, in a U-turn as a second segment into the second opening of the clamping device, out the first opening of the clamping device, and to the second intermediate portion of the rope. The second intermediate portion of the rope extends through the first slot, around the first and second pulleys, through the second slot and to the second end of the rope secured to the second handle. The first handle, at least, includes locating grooves in which the rope may be secured.

15 Claims, 9 Drawing Figures

EXERCISING APPARATUS WITH IMPROVEMENTS IN HANDLE STRUCTURE, ROPE ARRANGEMENT, AND CLAMPING MEANS

BACKGROUND OF THE INVENTION

1. Field of the Invention

The field of the invention relates to an exercising apparatus comprising a rope having at least one intermediate portion extending around pulley means and opposite ends which are held by the exerciser and selectively pulled by one hand against resistance provided by the other hand. Apparatuses of this general type include a rope placed around one or more pulleys and may be found among prior art patents in Class 272, Subclasses 116, 125, 131, 132, 133, and 134 in the U.S. Patent Office.

2. Statement of the Prior Art

Prior art references, which may be pertinent to the disclosed invention and are known to applicant, include the following:

U.S. Pat. No. 1,746,111—FISHER
U.S. Pat. No. 3,117,781—VARGO
U.S. Pat. No. 3,301,555—SICHERMAN
U.S. Pat. No. 3,355,171—OESAU
U.S. Pat. No. 3,369,809—MORRILL, Jr.
U.S. Pat. No. 3,851,874—WILKIN
U.S. Pat. No. 3,752,474—MACABET et al
U.S. Pat. No. 3,792,860—SELNES
U.S. Pat. No. 3,843,119—DAVIS
U.S. Pat. No. 3,910,573—JAMBA
U.S. Pat. No. 3,982,756—HERSEY et al

Of the prior art references known to applicant, the Fisher U.S. Pat. No. 1,746,111 and the Morrill, Jr. U.S. Pat. No. 3,369,809 appear to constitute the most relevant prior art, in particular, the latter. While both the Fisher and Morrill, Jr. patents relate to exercising devices comprising strap or rope members with an intermediate portion extending around pulley means and handles at the opposite ends, these prior art devices do not include means for readily shifting position of the handle and securely securing the end of the rope to selected positions of the handle as disclosed and claimed herein. Further, the known prior art apparatus do not include handles with rotatable grips. Additionally, the prior art apparatus do not use or suggest the use of quick release, automatic clamping member used in the disclosed invention for adjusting effective length of the rope.

SUMMARY OF THE INVENTION

The present invention relates to an improved exercising apparatus which is more versatile than the known prior art apparatuses of the same general variety or type.

Another object of the present invention is to provide new and improved handle structure for an exercising apparatus including means for readily releasing the rope end for a secured position on the handle and quickly tightening it around a new position.

Still another object of the present invention is to provide new and improved handle for an exercising apparatus including structure whereby the end of a rope may be secured at any of several locations on the handle whereby an exerciser may change the orientation of his arm, hand, and/or wrist.

Yet another object of this invention is to provide a new and improved handle for an exercising apparatus whereby risk of injury to the hand of the exerciser is greatly reduced.

A further object of this invention is to provide a new and improved rope clamp for an exercising apparatus which will readily facilitate change in effective length of the rope and which is automatic in operation against extension of the rope in the course of an exercise.

DETAILED DESCRIPTION OF THE INVENTION

Figure 1:
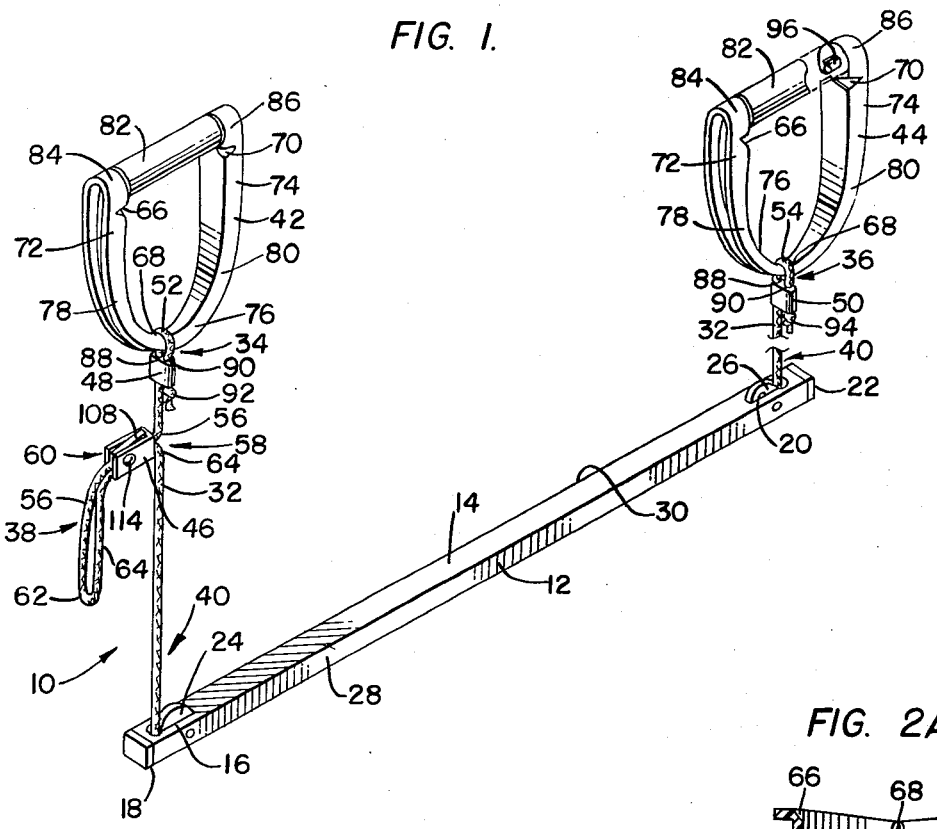
FIG. 1 is a view in perspective of an exercising apparatus according to the inventive concept disclosed herein with a portion of the rope at the right end of the apparatus broken away and omitted for lack of space.
Figure 2A:
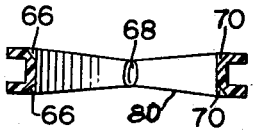
FIG. 2A is a sectional view taken along section 2A—2A and looking in the direction of the arrows in FIG. 2.
Figure 2:
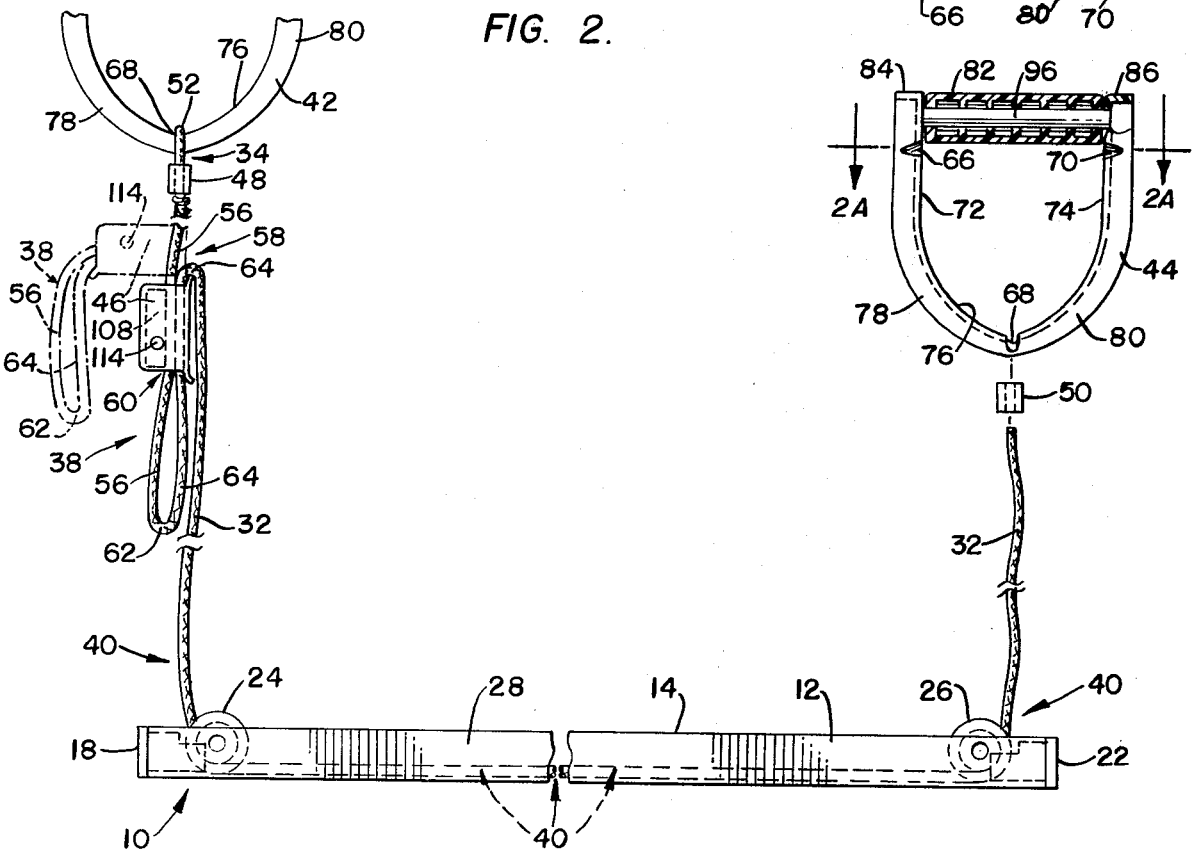
FIG. 2 is a front elevational view of the exercising apparatus of FIG. 1 on an enlarged scale and with additional portions broken away and omitted both for clarity and for lack of space.
Figure 6:
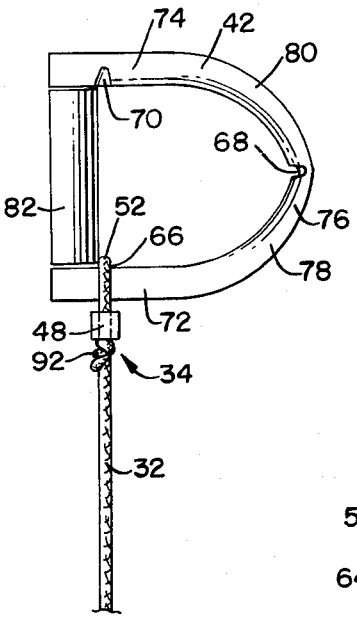
FIG. 6 is an elevational view of one of the handles and the rope end attached thereto appearing in FIG. 2, but with the handle changed to a different position with respect to the rope.

Referring now in detail to the drawings, the reader will readily appreciate from FIGS. 1, 2, 7, and 8 that the exercising apparatus 10 according to the inventive concept disclosed herein comprises in combination an elongate housing 12 with a first surface 14 having a first slot 16 adjacent one end 18 thereof and a second slot 20 adjacent the opposite end 22 thereof; first and second pulleys 24, 26 rotatably supported between opposite sides 28, 30 of the housing 12 and extending out of the first and second slots 16–20, respectively; a rope 32 having first and second ends 34,36 and first and second intermediate portions 38,40, respectively; first and second handles 42,44 secured to the first and second ends 34,36 of the rope 32, respectively; a clamping device 46 operably associated with the rope 32 for selectively extending or reducing the effective length of the rope 32; and loop forming members 48,50 for securing the first and second ends 34,36 of the rope 32 around the first and second handles 42,44, respectively. The loop forming members 48,50 are identical in structure and readily enables selective expansion and contraction of the loops 52,54 to position and secure either or both the first and second ends 34,36 of the rope 32 at any one of several desired locations on the handle 42,44. The first intermediate portion 38 of the rope 32 extends along a first segment 56 into a first opening 58 of the clamping device 46, out a second opening 60 of the clamping device 46, in a U-turn 62 as a second segment 64 into the second opening 60 of the clamping device 46, out the first opening 58 of the clamping device 46, and to the second intermediate portion 40 of the rope 32. The second intermediate portion 40 of the rope 32 extends through the first slot 16, around the first and second pulleys 24, 26, through the second slot 20 and to the second end 36 of the rope 32 secured to the second handle 44. Handles 42, 44 are each provided with a plurality of grooves or notches 66,68,70 on the inner periphery thereof for reception therein of loop 52 or 54 which may be drawn tightly therein or released therefrom by operation of the respective loop forming members 48,50. Each of the handles 42,44 is seen to comprise a pair of spaced-apart side members 72,74 between which a hand may be inserted, with a bight member 76 integral with and extending between intermediate portions 78,80 of the spaced-apart side members 72,74, grip member 82 extending between the side members 72,74 adjacent free ends 84,86 thereof. Each of the handles 42,44 also comprises a plurality of grooves, notches, or the like 66,68,70 in various positions and in which a rope loop 52 or 54 may be selectively received, drawn tightly therearound, and securely retained thereat. Groove 68 is located at the center of bight members 76, is arcuate in cross section and extends from along a front side of bight member 76, over along an inside of bight member 76, to along a back side of bight member 76, as may be readily envisioned in FIG. 2A. Grooves 66,70 are located on one of the pair of spaced-apart side members 72,74, adjacent one of the free ends 84,86, respectively of handles 42,44 and inboard of the grip member 82. Grooves 66,70 as seen in FIGS. 1,2, and 6 have V-shape contour. FIG. 2A shows each groove or notch 66,70 extending from along a front side of the spaced-apart side members 72,74 to about half way across the inside of the spaced-apart side member 72,74, respectively. Each of the grooves 66,70 is also seen in FIG. 2A to have in registration therewith a similarly numbered companion groove 66,70 extending from along the back side of the spaced-apart side members 72,74 to about half way across the inside of the spaced-apart side member 72,74, respectively.

The loop forming members 48,50, mentioned above, each comprises a solid body having a pair of generally parallel bores 88,90 through both of which rope 32 slidably extends to form loops 52,54 limited only by rope length and knots 92,94 at the very ends of rope 32 on the underside of loop forming members 48,50. From the foregoing, it is to be understood that change in orientation of handle 42, for example, from that illustrated in FIGS. 1,2, and 7 to that illustrated in FIGS. 6 and 8 is readily achieved by downward movement of loop forming member 48 to slide bore 88 along a portion of rope 32 above the first segment 56 to expand loop 52 to the extent that loop 52 may be released from groove 68 at the center of bight member 76 and shifted to either of grooves 66 or 70 adjacent to hand grip member 82. After loop 52 is shifted from groove 68 to grooves 66 and received therein as illustrated in FIG. 6, loop 52 is then contracted by slidably drawing the portion of rope 32 above first segment 56 down through bore 88 to the extent that loop 52 is secured around grooves 66 of handle 42.

Figure 7:
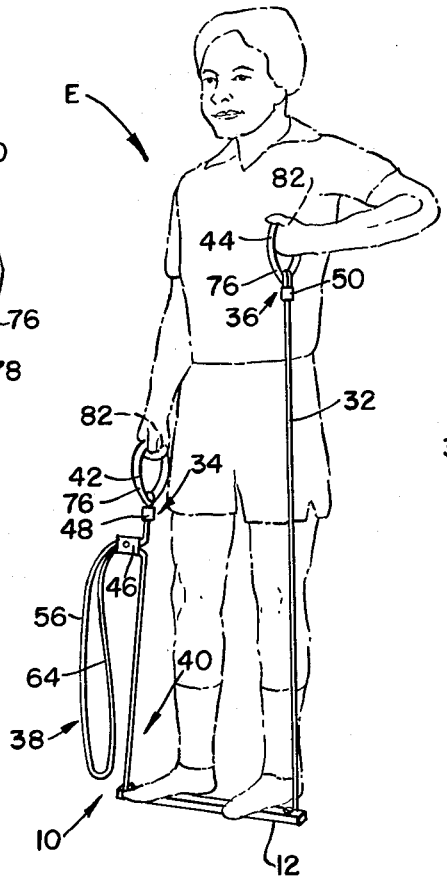
FIG. 7 is a view in perspective of the exercising apparatus according to the inventive concept disclosed herein and in use by an exerciser with the grips of the handle oriented in a generally horizontal direction.
Figure 8:
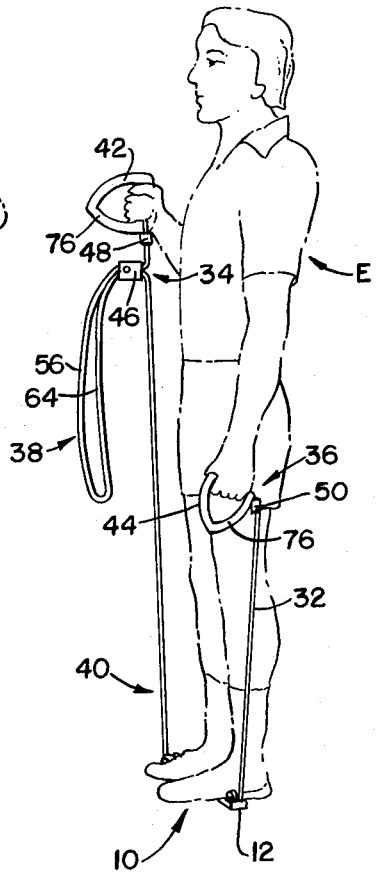
FIG. 8 is a view in perspective of the exercising apparatus according to the inventive concept disclosed herein and in use by an exerciser with the grips of the handle oriented at a generally vertical direction and/or at an incline to the horizontal direction.

A careful study of the exerciser's hands in FIGS. 7 and 8 will readily reveal that in FIG. 7 the palms of the hands extend around handles 42,44 with the grip members thereof held in a generally horizontal direction whereas in FIG. 8 the palms of the exerciser's hands will be around handles 42,44 with the grip members in a generally vertical direction, particularly in the upper position of the hands and the upward movement of the hands in the course of an exercise. The significance of the different orientation of the grip members 82 and the exerciser's hands will readily be appreciated by the reader upon adequately considering the consequent different orientation of the exerciser's wrists, arms, and muscles associated therewith. In this regard the change in orientation of grip members 82 and the exerciser's palms and/or wrists from that of FIG. 7 to that of FIG. 8 will impose different stresses to the various muscles involved in the use of exercising apparatus 10 and will thus develop the muscles differently.

To afford the exerciser maximum comfort insofar as the hands are concerned, the exercising apparatus 10 includes support rods 96 extending between adjacent free ends 84,86 of spaced-apart side members 72,74 of handles 42,44, around which support rods 96 grip members 82 extend in journaled relationship for free rotation thereabout.

Figure 3:
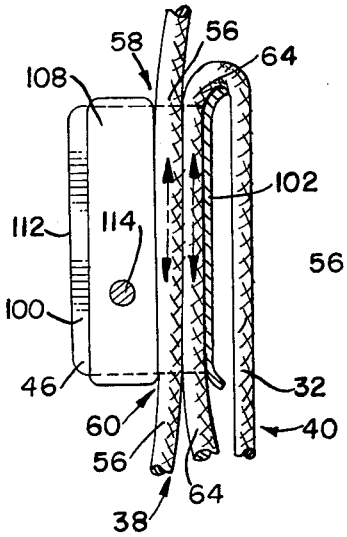
FIG. 3 is an elevational view of the rope clamp as it appears in solid lines in FIG. 2, but on an enlarged scale and with the near portion thereof broken away and omitted to expose details otherwise hidden from view.
Figure 4:
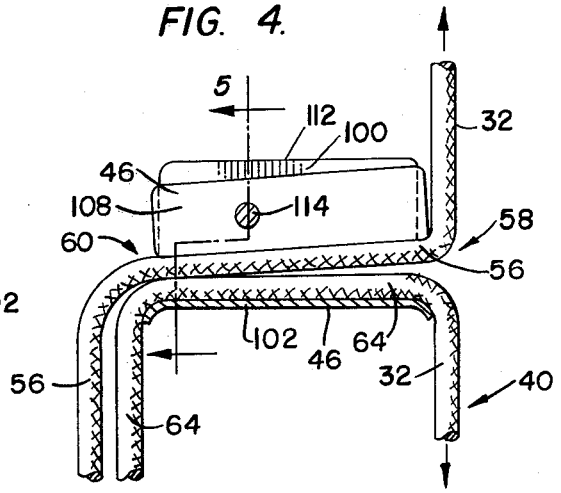
FIG. 4 is an elevational view of the rope clamp as it appears in dotted lines in FIG. 2, but on an enlarged scale and with the near portion thereof broken away and omitted to expose details otherwise hidden from view.
Figure 5:
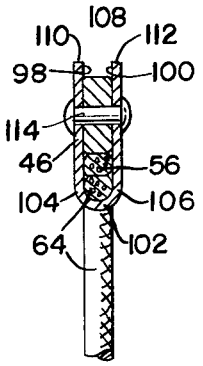
FIG. 5 is a sectional view taken along the section 5—5 and looking in the direction of the arrows.

Adding to the versatility of exercising apparatus 10 is clamp device 46 operatively associated with rope 32 to selectively extend or reduce the effective length of the latter depending upon the size of a particular exerciser or upon the length requirements of any exerciser as determined by the type of exercise. Clamp device 46 comprises a pair of spaced-apart surface portions 98,100 joined by a bridge member 102 integral with first adjacent edges 104,106 thereof and a wedge member 108 disposed between the spaced-apart surface portions 98,100 and in the vicinity of second adjacent edges 110,112 of the spaced-apart surface portions 98,100, as may be seen in FIGS. 3–5 considered together with FIGS. 1 and 2. The wedge member 108 is pivotally connected to the spaced-apart surface portions 98,100 by a pin 114 extending successively through one of the spaced-apart surface portions 98, through the wedge member 108, and through the other of the spaced-apart surface portions 100.

The specific relationship between rope 32 and clamping device 46 with greater consideration of details than previously described above can readily be seen in FIGS. 1–5 wherein rope 32 extends from loop forming member 48, which facilitates selective expansion and contraction of loop 52, along first segment 56 of first intermediate portion 38 into first opening 58 of clamping device 46 between spaced-apart surface portions 98, 100 and simultaneously between wedge member 108 and bridge member 102, out second opening 60, along U-turn 62 and second segment 64 into second opening 60, again between spaced-apart surface portions 98, 100 and simultaneously between wedge member 108 and bridge member 102, out first opening 58 and to second intermediate portion 40 and the other end of rope 32. Further, with respect to clamping device 46, it is to be understood that spaced-apart surface portions 98,100 are far enough from each other to allow free passage of first and second segments 56,64, wedge member 108 is pivotable to a position generally parallel to bridge member 102 when segments 56,64 may pass freely therebetween and to an inclined position to bridge member 102 to clamp and lock segments 56,64 from passage therebetween. When handle 42 is held so that rope 32 is in slack or limp condition as illustrated in FIG. 2, clamping device 46 may extend, as illustrated with solid lines, in a generally vertical direction with segments 56,64 extending generally parallel therewith and with relative freedom of movement of clamping device 46 with respect to segment 56 and/or segment 64 in the direction of arrows in FIG. 3 whereby the effective length of rope 32 may be selectively extended or reduced. On the other hand, when rope 32 is drawn into a taut condition due to a lifting force on handle 42 in opposition to resistance at handle 44, the lifting force and resistance being represented in FIG. 4 by oppositely directed arrows, clamping device 46 will be urged to the generally horizontally extending position as clearly illustrated in FIGS. 1 and 4 in solid lines and also in FIG. 2 in dotted lines. The downwardly directed resistance applied to rope 32 may be seen in FIG. 4 to act against bridge member 102 to rotate clamping device about 90° from the position of FIG. 3 to that of FIG. 4 while the upwardly directed force pulls wedge member 108 in the vicinity of first opening 58, causing wedge member 108 to pivot around pin 114 causing wedge member 108 to clamp segments 56,64 of rope 32 tightly against bridge member 102 in the vicinity of second opening 60 so that the selected length of rope 32 may be maintained, particularly in the course of an exercise. Another feature of clamping device 46 of noteworthy consideration is the location of pivot pin 114, which for effective operation of clamping device 46, is closer to second opening 60 than it is to first opening 58 whereby any force tending to separate segments 56,64 adjacent to first opening 58 will cause wedge member 108 and bridge member 102 to pivot away from each other adjacent first opening 58 but toward each other adjacent second opening 60 and thereby clamp rope segments 56,64 against movement therefrom.

From the end of second segment 64 of first intermediate portion 38 adjacent first opening 58 of clamping device 46, it is readily apparent that rope 32 includes a second intermediate portion 40 operatively associated in combination with first and second pulleys 24,26 rotatably supported by elongate housing 12 as described above to provide the disclosed exercising apparatus 10 as described above. For best operation, pulleys 24,26 are grooved to receive rope 32 as may be readily seen in FIG. 1 to provide fpositive positioning of rope 32.

In carrying forth the disclosed invention to practice, applicant suggests that rope 32 be of N ylon so as to be tangle-proof and strong enough to withstand the forces involved; and that elongate housing 12 be a hollow anodized aluminum bar to provide a durable and light weight apparatus.

Numerous variations of exercises may be carried out with the disclosed exercising apparatus 10 including that in which the palms of the exerciser E extend around generally horizontally extending grips 82 as illustrated in FIG. 7 and that in which the palms of the exerciser E extend around grips 82 extending at an incline to the horizontal or generally vertically as illustrated in FIG. 8. The exercise may be conducted with the exerciser standing on elongate housing 12 or with elongate housing secured to the floor, placed against the underside of a chair on which the exerciser may be seated. Exercising apparatus 10 may also be used with either or both of the exerciser's arms extended outwardly laterally to the left and/or right or extended outwardly to the front. The single requirement to which exercising apparatus 10 of the disclosed invention must be strictly adhered, is that a pulling force applied to one of the handles 42,44 must be in the course of an exercise be accompained by resistance applied to the other of the handles 42,44.

It will be obvious to those skilled in the art that various changes may be made without departing from the scope of the invention and the invention is not to be considered limited to what is shown in the drawings and described in the specification.

What is claimed is:

1. Handle for an exercising apparatus comprising a pair of spaced-apart side members, between which a hand may be inserted, with a bight member integral with and extending between intermediate portions of said spaced-apart side members, grip means extending between said side members adjacent free ends thereof, said handle including a plurality of grooves for retaining a rope loop received in selected positions thereon, when the grip means is oriented to different positions with respect to an exercise rope when the latter is in one of said selected grooves, with one of said grooves being located at the center of said bight member and at least one other of said plurality of grooves being located on one of said pair of spaced-apart side members adjacent the free end thereof and inboard of said grip means.

2. Handle as defined in claim 1 wherein said one of said grooves is arcuate in cross section, and extends from along a front side of said bight member, over along an inside of said bight member, to along a back side of said bight member.

3. Handle as defined in claim 1 wherein said at least one other of said plurality of grooves extends from along a front side of the said one of said pair of spaced-apart side members to about half way across the inside of the said one of said pair of spaced-apart side members.

4. Handle as defined in claim 3 wherein the said one of said pair of spaced-apart side members is provided with another of said plurality of grooves extending from along a back side thereof to about half way across the inside thereof and in registration with said at least one other of said plurality of grooves.

5. Handle as defined in any one of said claims 1, 2, 3 or 4 wherein said grip means comprises a rotatable member extending around a support rod in journaled relationship therewith, said support rod extending between said spaced-apart side members and being fixed thereto adjacent the ends thereof.

6. Handle as defined in claim 5, in combination with a second handle, a rope with a loop at a first end thereof, said loop extending around the first one of said handles; and means for selectively expanding and contracting said loop adjacent the first of said handles whereby said rope may be shifted from one of said grooves to another and secured at the latter, said rope being secured at its other end to said second handle.

7. Handle in combination with structure as defined in claim 6 wherein said rope includes a first intermediate portion between opposite ends thereof and means operatively associated with said rope to selectively extend or reduce the effective length thereof.

8. Handle in combination with structure as defined in claim 7 wherein said means for extending or reducing the effective length of said rope comprises a pair of spaced-apart surface portions joined by a bridge member integral with first adjacent edges thereof and a wedge member disposed between said spaced-apart surface portions and in the vicinity of second adjacent edges of said spaced-apart surface portions.

9. Handle in combination with structure as defined in claim 8 wherein said wedge member is pivotally connected to said spaced-apart surface portions by a pin extending successively through one of said spaced-apart surface portions, through said wedge member, and through the other of said spaced-apart surface portions.

10. Handle in combination with structure as defined in claim 9, said rope extends as a first segment inwardly from the means for expanding and contracting the loop at one end thereof into a first opening at one end of said means for extending or reducing the effective length of said rope, between said spaced-apart surface portions and simultaneously between said wedge member and said bridge member, out a second opening at the other end of said means for extending or reducing the effective length of said rope, in a U-turn as a second segment into said second opening again between said spaced-apart surface portions and simultaneously between said wedge member and said bridge member, out said first opening and to the other end of said rope.

11. Handle in combination with structure as defined in claim 10 wherein spaced-apart surface portions are far enough from each other to allow free passage of said segments, said wedge member is pivotable to a position generally parallel to said bridge member to permit said segments to pass freely therebetween and to an inclined position to said bridge member to lock said segments from passage therebetween.

12. Handle in combination with structure as defined in claim 1 wherein said pivot pin is closer to said second opening than it is to said first opening whereby any force tending to separate said segments adjacent to said first opening will cause said wedge member and said bridge member to pivot away from each other adjacent said first opening but toward each other adjacent said second opening and thereby clamp said rope segments against movement therefrom.

13. Handle in combination with structure as defined in claim 12, in further combination with an exercising apparatus comprising an elongate housing with a first slot in a first surface adjacent one end thereof, a second slot in said first surface adjacent a second end thereof, first and second pulleys rotatably supported between opposite sides of said housing and extending out of said first and second slots, respectively, said rope including a second intermediate portion extending from said second segment at said first opening, through said first slot, around said first and second pulleys, through said second slot, and to said second handle.

14. Handle as defined in claim 2 wherein said grip means comprises a rotatable member extending around a support rod in journaled relationship therewith, said support rod extending between said spaced-apart side members and being fixed thereto adjacent the ends thereof, in combination with a second handle, a rope with a loop at the first end thereof, said loop extending around the first one of said handles; and means for selectively expanding and contracting said loop adjacent the first of said handles whereby said rope may be shifted from one of said grooves to another and secured at the latter, said rope being secured at its other end to said second handle, wherein said means for expanding and contracting said loops comprises a solid body having a pair of generally parallel bores through both of which said rope slidably extends to form a loop, said rope including means at the free end thereof to prevent escapement from said solid body.

15. Structure as defined in claim 14 wherein said pulleys are grooved.

* * * * *